US006769210B2

(12) United States Patent
Bubits

(10) Patent No.: US 6,769,210 B2
(45) Date of Patent: Aug. 3, 2004

(54) AIMING DEVICE FOR PISTOLS

(76) Inventor: Wilhelm Bubits, Franz Anderle Platz 3/4/6 A-2345 Brunn, Gebirge (AT)

( * ) Notice: Subject to any disclaimer, the term of this patent is extended or adjusted under 35 U.S.C. 154(b) by 0 days.

(21) Appl. No.: 10/374,394

(22) Filed: Feb. 26, 2003

(65) Prior Publication Data

US 2004/0010956 A1 Jan. 22, 2004

(30) Foreign Application Priority Data

May 28, 2002 (AT) ..... 340/2002 U

(51) Int. Cl.[7] ..... F41G 1/00
(52) U.S. Cl. ..... 42/113; 42/141
(58) Field of Search ..... 42/113, 141, 145, 42/144, 142, 111–148

(56) References Cited

U.S. PATENT DOCUMENTS 3,192,632 A 7/1965 Von Stavenhagen ..... 33/47
3,641,676 A * 2/1972 Knutsen et al. ..... 42/136
5,070,619 A * 12/1991 Santiago ..... 42/144
5,359,800 A * 11/1994 Fisher et al. ..... 42/145
5,404,667 A * 4/1995 Schmitter ..... 42/111
5,735,070 A * 4/1998 Vasquez et al. ..... 42/1.02
6,058,615 A * 5/2000 Uhlmann et al. ..... 42/132
6,230,414 B1 * 5/2001 Glock ..... 42/139

* cited by examiner

*Primary Examiner*—Michael J. Carone
*Assistant Examiner*—Denise Buckley
(74) *Attorney, Agent, or Firm*—Bachman & LaPointe, P.C.

(57) ABSTRACT

An aiming device for pistols comprises a rear sight (2) and front sight having a luminous dot on the side facing the eye (rear sight). The rear sight has a luminous mark and a recess which accommodates the contour of the front sight. The recess comprises a base line or bottom wall and two side lines or side walls. For aiming in poor visibility, the rear sight has a trapezoidal external contour, with the inclined trapezoid sides forming an acute angle at their upper ends with the side lines of the recess, and the rear sight has a second luminous dot centrally under the recess which is located precisely under the first luminous dot on the front sight when the pistol is being aimed.

8 Claims, 1 Drawing Sheet

AIMING DEVICE FOR PISTOLS

BACKGROUND OF THE INVENTION

The invention relates to an aiming device for pistols, comprising a rear sight and front sight, the front sight having a luminous dot on a side facing the eye, and the rear sight has a luminous mark and a depression which accommodates a contour of the front sight, an inner contour comprises a base line and two side lines which are generally vertical.

With aiming devices such as these, the azimuth is adjusted during the aiming process by making the upper edge of the front sight coincident with the upper edge of the rear sight ("aligned front sight"), and the direction is adjusted by comparing the width of the unobstructed gaps on both sides between the side lines and the contour of the front sight. The luminous mark is intended to assist the person firing the weapon when the light is poor or the person firing the weapon has poor eyesight.

Adjustment of the azimuth requires a rear sight with a broad upper edge which gives the appearance of a line covering the recess. A broad rear sight such as this conceals the majority of the target, however, so that the front sight—and hence also the cut-out in the rear sight—must be relatively large in order to be sufficiently visible. Lateral aiming on the basis of the unobstructed gaps is also very tedious when visibility is poor.

In order to assist aiming in poor visibility, or to improve the hit probability, it is known from practice for two further luminous dots to be applied to the rear sight, with a certain lateral offset, which are at the same height as the luminous dot on the front sight when the azimuth aim is correct. For lateral aiming, the latter must be precisely in the center of the connecting line between the two luminous dots on the rear sight. This is a very difficult task for the eye and, above all, it takes time. Furthermore, the two luminous dots are brighter overall than the luminous dot on the front sight and, in addition, are closer to the eye, so that they mask out the latter, as well as the target when the lighting is dim.

An aiming device of this generic type is known from U.S. Pat. No. 3,192,632, in which a vertical line is provided on the rear sight, under the luminous dot on the front sight, in order to assist lateral aiming. However, this does not help with azimuth aiming.

The object of the invention is to improve aiming in poor visibility, both with regard to target acquisition and with regard to aiming the weapon at the target.

SUMMARY OF THE INVENTION

According to the invention, the object is achieved wherein a rear sight has a trapezoidal external contour, with the inclined trapezoid sides forming an (possibly rounded) acute angle at their upper ends with the side lines (side walls) of an inner recess, and wherein the rear sight has a luminous dot centrally located under the recess, which is located precisely under a first luminous dot on the front sight when the pistol is being aimed.

The trapezoidal external contour conceals much less of the target. The second luminous dot, which is likewise circular, is aimed such that it is located with a slight separation precisely underneath the first luminous dot. The interaction of the two circular luminous dots not only simplifies lateral aiming but, surprisingly, also allows quicker but nonetheless accurate aiming in azimuth. There is thus no longer any need for a broad rear sight. Thus, overall, the aiming device can be designed to be smaller, which also simplifies intuitive aiming owing to the shorter distance from the barrel axis.

In a preferred embodiment the luminous dots, both the first and the second, may be formed by a capsule containing a luminous substance, and the width and height of the front sight are only slightly larger than the diameter of the capsule which may be a small tritium tube, which is known by this name in the specialist world. The capsule is sheathed and held securely in this way. Thanks to the aiming function of the two luminous dots in poor visibility, a small vertical distance between them has no disturbing effect. Since the second luminous dot is under the first and is also under the target, it cannot mask out either one or the other.

The luminous dots need not be large, so that the rear sight and the front sight may also be designed to be small. In this case, the second luminous dot may be smaller than the first luminous dot and in the same ratio as their distances from the eye. The two luminous dots then appear to be of equal size to the eye, thus allowing faster aiming owing to the physiology of the human eye. Alternatively or in a complementary manner, the second luminous dot may also be less luminous than the first.

BRIEF DESCRIPTION OF THE DRAWINGS

The invention will be described and explained in the following text with reference to figures, in which.

DETAILED DESCRIPTION

Figure 1:
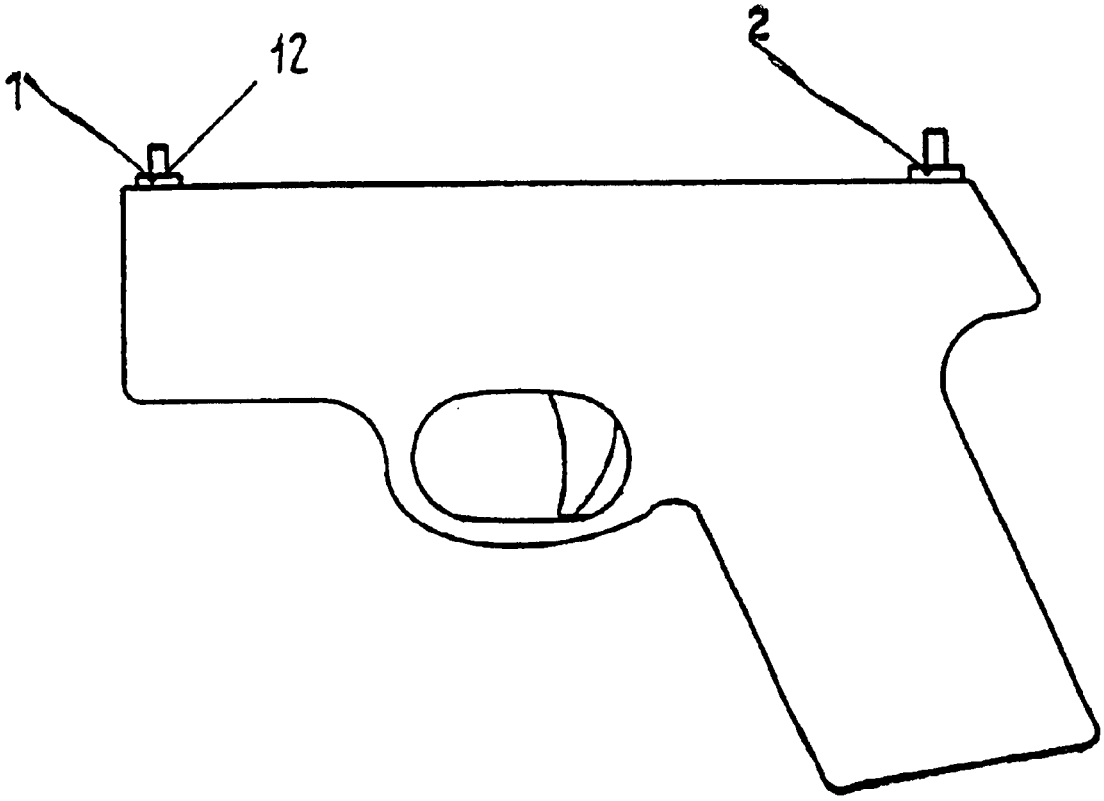
FIG. 1 shows a pistol with the device according to the invention.
Figure 2:
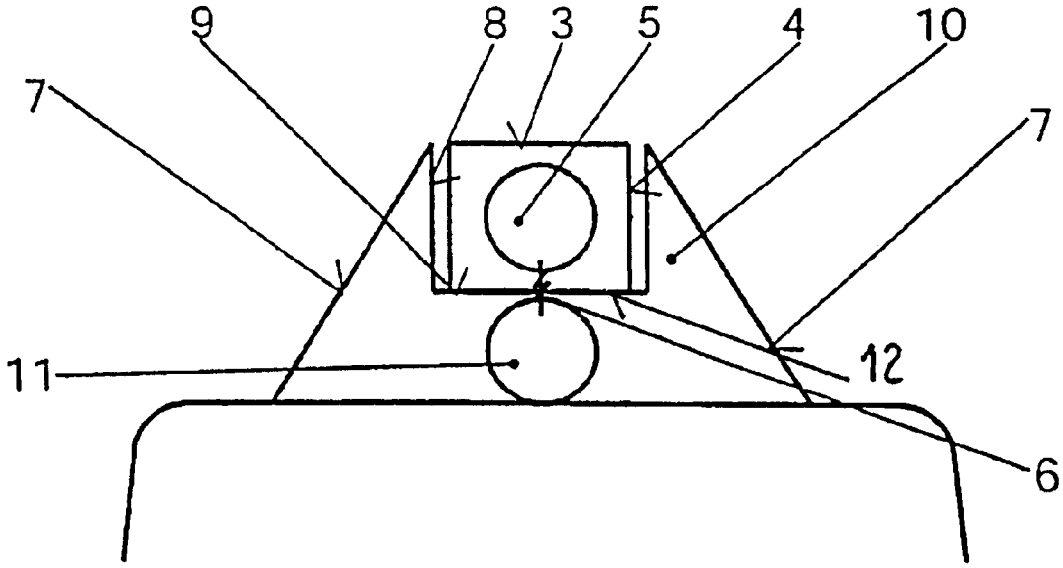
FIG. 2 shows a view of the device according to the invention from the rear.

FIG. 1 shows a pistol with the device according to the invention, just in the form of its outline, in order to show that the front sight 1 is located at the front of the weapon, and the rear sight 2 is located at the rear of the weapon. FIG. 2 then shows these sights as they appear to the eye of the person firing the weapon, when aiming.

The front sight 1 is a vertical pin or cuboid, whose outline which is visible from the rear comprises an upper edge 3 (upper wall) side edges 4 (side walls) and base line 12. A first circular luminous dot 5 is arranged between these three edges such that it is at a slight distance 6 from them.

The luminous dot 5 may be formed by a phosphorescent paint or by a capsule which contains a luminous substance combination. A so-called "small tritium tube" can be considered in particular in this case, which has relatively small dimensions, but must be securely surrounded by the supporting body, in this case the front sight 1. A minimal distance 6 from the side edge is therefore important.

The rear sight 2 is a body or a transverse plate, which offers a silhouette to the eye of the person firing the weapon which comprises inclined trapezoid sides 7, which form the external contour, and an inner contour which is in the form of a recess formed by two side lines (side walls) 8 and a lower edge (bottom wall) 9. The inclined trapezoid sides 7 each enclose an acute angle 10 with the side lines or side walls 8. Under the center of the lower edge 9, the rear sight 2 has a second circular luminous dot 11, once again with the same distance 6 between its circumference and the lower edge 9. This second luminous dot 11 may be smaller than the first, and/or may be less luminous as discussed above.

When the pistol is aligned correctly during aiming, then the person firing the weapon sees a view as in FIG. 2. The upper edge of the front sight is located on the upper line of the trapezoid, and the unobstructed gaps on both sides are located between the side lines 8 and the side edges 4 of the front sight 1. If visibility is poor, all that then need be done is to place the two circular luminous dots 5, 11 one above the other.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An aiming device for pistols, comprising a rear sight and front sight, the front sight having a contour and a first luminous dot on a side facing the rear sight, the rear sight includes a recess having side walls and a bottom wall which accommodates the contour of the front sight, said contour comprises a base line and two side edges, wherein the rear sight has a trapezoidal external contour having inclined trapezoid sides, with the inclined trapezoid sides forming an acute angle at their upper ends at intersection points with the side walls of the recess, and wherein the rear sight has a second luminous dot located centrally under the recess, wherein the second luminous dot is located precisely under the first luminous dot on the front sight when the pistol is aimed.

2. The aiming device as claimed in claim 1, wherein the recess in the rear sight and the contour of the front sight are rectangular having a width and a height.

3. The aiming device as claimed in claim 2, wherein the width and the height of the front sight is only slightly greater than the diameter of the first luminous dot.

4. The aiming device as claimed in claim 2, wherein the recess in the rear sight has a depth which is sized so that, when the pistol is aimed, the bottom wall of the rear sight is substantially the same distance from the first luminous dot as the contour of the front sight.

5. The aiming device as claimed in claim 1, wherein the second luminous dot is smaller than the first luminous dot and appear of equal size to the eye when the pistol is aimed.

6. The aiming device as claimed in claim 1, wherein the second luminous dot is less luminous than the first luminous dot.

7. The aiming device as claimed in claim 3, wherein at least one of the luminous dots is a small tritium tube.

8. The aiming device as claimed in claim 1, wherein the first sight has an upper edge which is located adjacent the intersection points of the inclined trapezoid sides and the side wall of the recess when the pistol is aimed.

* * * * *